156-348 SR
10/22/85 OR 4,548,273

United States Patent [19]

Leicht et al.

[11] Patent Number: 4,548,273

[45] Date of Patent: Oct. 22, 1985

[54] TORQUE MULTIPLIER SUBSEA TOOL

[75] Inventors: Frederick M. Leicht; Benton F. Baugh; Harish C. Palany, all of Houston, Tex.

[73] Assignee: Smith International, Inc., Newport Beach, Calif.

[21] Appl. No.: 554,208

[22] Filed: Nov. 22, 1983

[51] Int. Cl.[4] ..... E21B 23/06; E21B 33/043

[52] U.S. Cl. ..... 166/348; 166/123; 166/182; 166/387; 285/18; 285/DIG. 13

[58] Field of Search ..... 166/348, 387, 123–125, 166/181, 182, 208; 285/DIG. 13, 39, 2, 18, 140–143; 175/106; 81/57.18, 57.14; 74/801, 785, 788

[56] References Cited

U.S. PATENT DOCUMENTS

| | | | |
|---|---|---|---|
| Re. 29,993 | 5/1979 | Wagner | 74/750 R |
| 3,054,449 | 9/1962 | Schramm et al. | 166/66.5 |
| 3,293,948 | 12/1966 | Jarchow et al. | 74/801 |
| 3,322,006 | 5/1967 | Brown | 81/57.18 |
| 3,357,486 | 12/1967 | Brown | 166/0.6 |
| 3,450,204 | 6/1969 | Brown et al. | 166/182 |
| 3,543,847 | 12/1970 | Haeber | 166/0.6 |
| 3,693,714 | 3/1971 | Baugh | 166/0.6 |
| 3,807,497 | 4/1974 | Baugh | 166/85 |
| 3,837,684 | 9/1974 | Hynes | 285/3 |
| 3,871,449 | 3/1975 | Ahlstone | 166/183 |
| 3,885,625 | 5/1975 | Ahlstone | 166/181 |
| 3,924,678 | 12/1974 | Ahlstone | 166/120 |
| 3,933,202 | 12/1975 | Ahlstone | 166/182 |
| 4,019,579 | 4/1977 | Thuse | 166/182 X |
| 4,254,669 | 3/1981 | Schulz | 175/106 X |
| 4,333,528 | 6/1982 | Woodman | 81/57.18 X |
| 4,431,054 | 2/1984 | Woodman | 166/125 |

*Primary Examiner*—James A. Leppink
*Assistant Examiner*—Hoang C. Dang
*Attorney, Agent, or Firm*—Ned L. Conley; David A. Rose; William E. Shull

[57] ABSTRACT

A torque multiplier subsea tool for setting a seal between a casing hanger and a subsea wellhead includes a mandrel having a sun gear with axial elongate teeth. An outer barrel is disposed around the mandrel forming an annulus therebetween. A planetary gear assembly is disposed in the annulus between the barrel and the sun gear to transmit to the barrel a torque which is higher in magnitude than that applied to the mandrel. A connector body disposed around the mandrel, below the planetary gear assembly, includes radially movable dogs for engaging the casing hanger. The barrel engages the sealing assembly and transmits the increased torque thereto to advance the sealing assembly downwards and to set the seal. The mandrel advances downwards with the sealing assembly and releases the dogs from the casing hanger. An emergency release mechanism is provided to advance the mandrel downwards to release the dogs in the event such downward movement is prevented during normal seal setting operation.

27 Claims, 8 Drawing Figures

TORQUE MULTIPLIER SUBSEA TOOL

CROSS REFERENCE TO RELATED APPLICATIONS

This application is related to the subsea wellhead system disclosed in prior U.S. patent applications Ser. No. 348,735, filed on Feb. 16, 1982, now pending, Ser. No. 350,374, filed on Feb. 19, 1982, now pending, and Ser. No. 535,045, filed on Sept. 23, 1983, now pending. These applications are owned by the assignee of the present application, and their disclosures are incorporated herein by reference.

TECHNICAL FIELD

The present invention relates generally to the field of oil or gas well completion and, more particularly, to the art of setting a seal between a casing hanger and a subsea wellhead. Still more particularly, the present invention includes a tool for running a casing hanger assembly and a sealing assembly down to the subsea wellhead and for setting the seal between the casing hanger and the wellhead by applying a torque input to the tool, increasing the torque by means of the tool resulting in a torque output from the tool that is greater than the torque input, and applying the increased torque output to the sealing assembly.

BACKGROUND OF THE INVENTION

Increased activity in offshore drilling and completion has caused an increase in working pressures such that new offshore wells, including some that are being drilled off the coast of Canada and in the North Sea in depths over 300 feet, have working pressures of as high as 15,000 psi. Drilling operations in these wells generally include a floating vessel having a heave compensator for a riser and drill pipe extending to the blowout preventer and wellhead located at the mud line. The blowout preventer stack is generally mounted on 20 inch pipe with the riser extending to the surface. A quick disconnect is often located on top of the blowout preventer stack. An articulation joint is used to allow for vessel movement. One problem related to the subsea wells having such high working pressures approaching 15,000 psi is to provide an energizing means for setting a sealing means between the casing hangers and the wellhead which will withstand and contain such working pressure, without subjecting the drill string and related apparatus at the surface and at the wellhead to unduly high or excessive torque. It is an object of the present invention to provide for such an energizing means that is simple, easy to manufacture, easy to install and retrieve, and reliable.

Energizing means, in general, for energizing and setting a sealing means between a casing hanger and a wellhead in an underwater oil or gas well are well known. See, for example, the energizing means disclosed in U.S. Pat. Nos. 3,054,449, 3,357,486, 3,543,847, 3,693,714 and 3,933,202.

One common method of actuating such a sealing means is by applying weight force on the sealing member, for example, via drill collars, to expand it in the annulus. Weight energizing means is the least desirable because the handling of drill collars providing the weight required for high sealing pressure is difficult and time consuming on the rig floor. Weight energizing means are disclosed in U.S. Pat. Nos. 3,054,449; 3,543,847, combined with hydraulic pressure actuation means, hereinafter described; and U.S. Pat. No. 3,933,202.

Another method for actuating such a sealing means is by applying hydraulic pressure from the surface to the underwater wellhead to expand and set the sealing assembly in the annulus between the casing hanger and the wellhead housing. If hydraulic pressure is applied through the drill pipe, one drawback is that there is a need for wireline equipment to run and recover darts from the hydraulically activated seal energization system. If darts are not used, the handling of "wet strings" of drill pipe is very messy and unpopular with drilling crews. If the seal energization means uses the single trip casing hanger technique, the cementing fluid can cause problems in the hydraulic system used to energize the seal. Furthermore, maintenance is also a problem when hydraulic activated systems are used. Hydraulic pressure activated systems are disclosed in U.S. Pat. Nos. 3,357,486; 3,543,847, combined with aforementioned weight activation means; and U.S. Pat. No. 3,693,714.

The most desirable method to energize a seal is by applying torque on the drill string extending to the underwater wellhead which in turn rotates and advances on threads a packing nut which axially compresses and radially expands the seal assembly in the annulus between the casing hanger and the wellhead. However, it is desirable to minimize the amount of torque applied to the drill string to reduce the wear and tear on the torque generating apparatus at the surface and the drill string itself and therefore, to reduce the chances of failure. Moreover, there are limitations on the amount of torque which can be transmitted from the surface due to friction losses and the like.

The tool of the present invention enables one to set a seal to withstand the high working pressures discussed above which are expected in some new underwater oil or gas wells by applying to the drill string a torque which is substantially lower than the torque ultimately applied by the tool on the sealing assembly. Thus, the sealing assembly can be torque set to withstand the higher working pressures while limiting the torque applied to the drill string to an amount that does not unduly stress the drill string and related apparatus used to run the casing hanger and sealing assemblies into the well and to set the seal.

Other objects and advantages of the invention will appear from the following description.

SUMMARY OF THE INVENTION

In accordance with the preferred embodiment of the present invention, a torque multiplier subsea tool includes an inner mandrel having a sun gear with exterior axial teeth. A planetary gear assembly is disposed over the sun gear. The planetary gear assembly includes a planet gear carrier body that houses circumferentially spaced planetary gears having teeth engaging the teeth of the sun gear. The planet gear carrier body has an upper portion with exterior axial teeth and a lower portion received by a ring gear having interior axial teeth that engage the teeth of the planetary gears that are diametrically opposite to the teeth engaging the sun gear. The ring gear is disposed over and connected to the upper portion of a connector body. The connector body is disposed over the inner mandrel below the planetary gear assembly and it includes radially movable locking dogs having grooves forming ridges therebetween adapted to engage a casing hanger. A barrel is disposed over the inner mandrel, the planetary gear assembly and the connector body. The barrel includes interior axial teeth engaging the exterior teeth of the planet carrier body and a lower castellated end for engaging and transmitting torque to the sealing assembly.

In operation, the torque multiplier subsea tool suspended from a drill string and having a casing hanger and a sealing assembly attached thereto through the locking dogs, is lowered into the subsea wellhead until the casing hanger lands on a conical or other appropriately shaped, e.g., flat, wellhead shoulder. Torque applied to the sun gear through the drill string is multiplied through the planet gear assembly and transmitted to the barrel at a higher magnitude and a lower rpm, thus resulting in the mechanical advantage. The barrel transmits the higher torque to the sealing assembly, which advances downwards on threads on the casing hanger to set the seal. As the sealing assembly advances downwards, the outer barrel and the inner mandrel advance downwards also, releasing the locking dogs from the casing hanger and disengaging the tool from the casing hanger. The tool may then be picked straight up to the surface leaving the casing hanger and the sealing assembly at the bottom of the sea.

In the event that the sealing assembly fails to advance downwards to enable normal release of the tool, the inner mandrel is advanced downwards to release the locking dogs by rotating to the right an emergency release nut connected to the top of the mandrel by a left hand thread. The right hand rotation of this nut shears an anti-rotation pin which prevents disengagement of the emergency release nut from the mandrel under normal operation.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

Figure 1A:
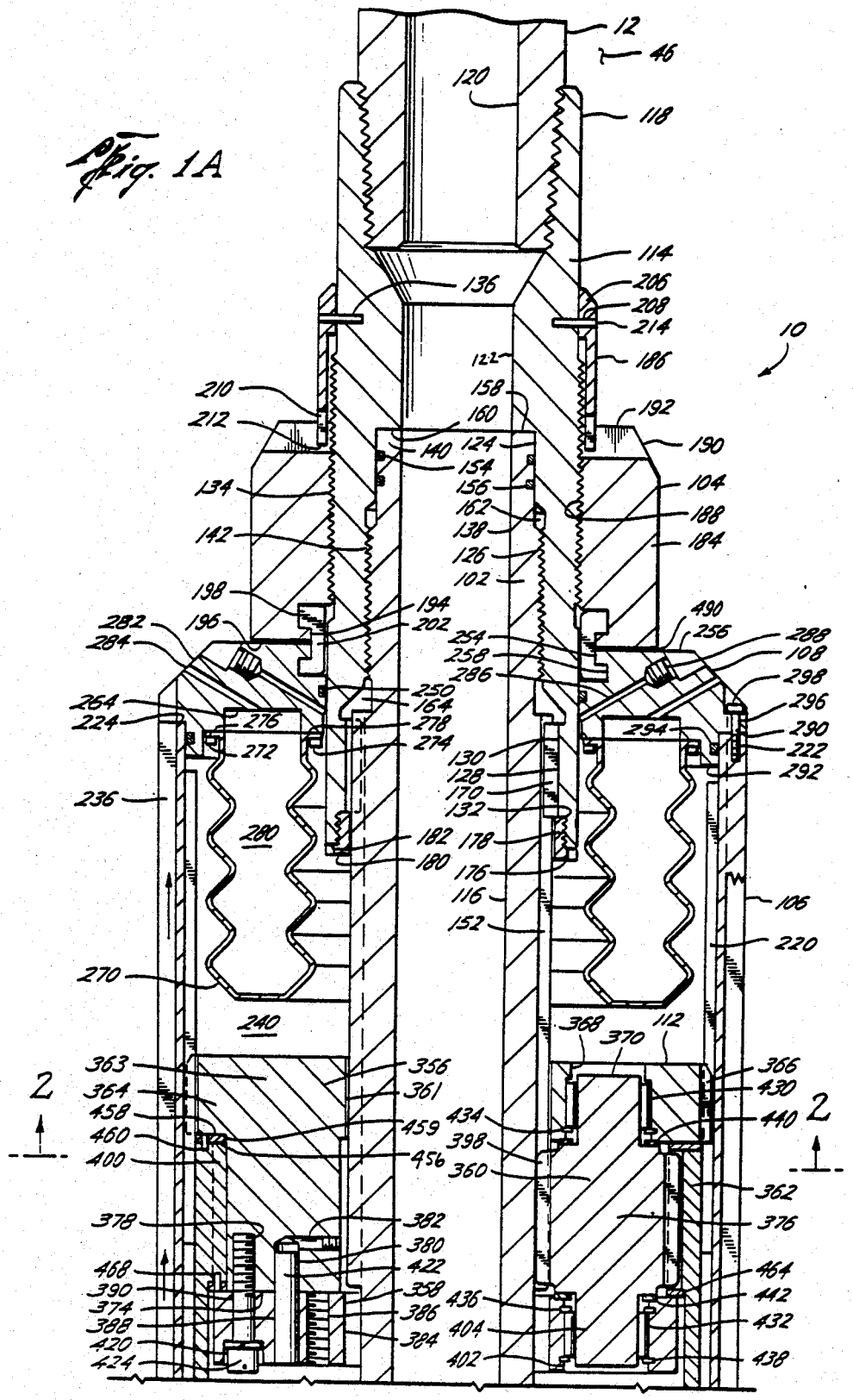
FIG. 1A is a longitudinal sectional view of the upper portion of the preferred embodiment of the apparatus of the present invention, in the running position.
Figure 1B:
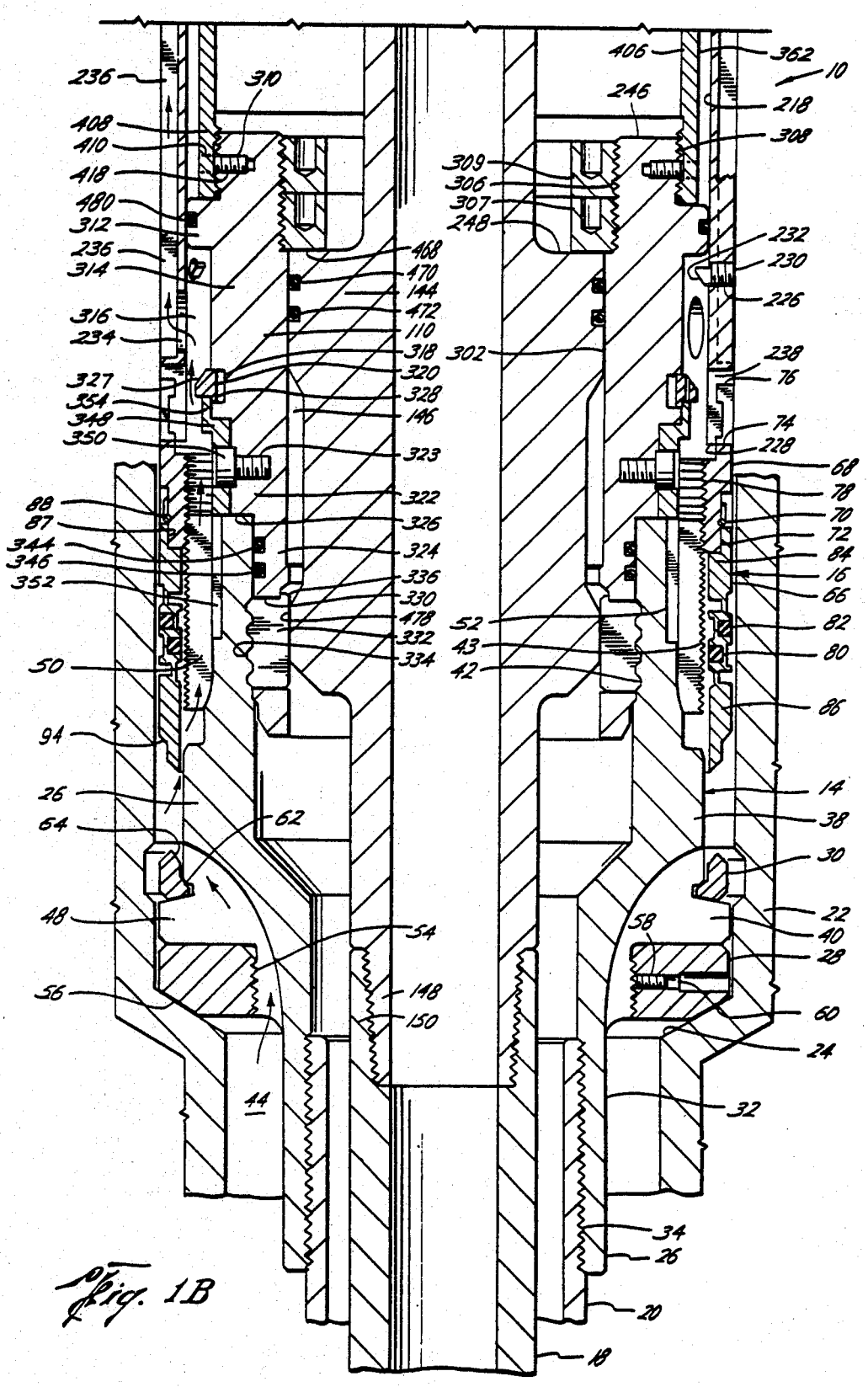
FIG. 1B is a longitudinal sectional view of the lower portion of the preferred embodiment of the apparatus of the present invention shown in FIG. 1A, in the running position.

The present invention is a well apparatus for running a casing hanger and sealing assembly into a subsea well and for setting the seal in the annulus between the casing hanger and a wellhead housing or other tubular member. Referring initially to FIGS. 1A and 1B, there is shown torque multiplier subsea tool 10 in the running position suspended from a drill string 12 and having casing hanger assembly 14 and sealing assembly 16 attached thereto. Drill string 18 and casing string 20 are suspended from torque multiplier subsea tool 10 and casing hanger assembly 14, respectively. The assembled tool string is lowered into wellhead housing 22 to rest on conical wellhead shoulder 24.

Casing hanger assembly 14 includes a casing hanger 26, a load ring 28 and a latch ring 30. Casing hanger 26 has a generally tubular body 32 which includes a lower threaded box 34 threadingly engaging the upper joint of casing string 20 for suspending string 20 within the borehole (not shown), a thickened upper section 38 having an externally projecting radial annular shoulder 40, and a plurality of circumferential grooves 42 in the inner periphery of body 32 adapted for connection with torque multiplier subsea tool 10, hereinafter described. Threads 43 are provided from the top down along a substantial length of the exterior of tubular body 32 for engagement with sealing assembly 16, hereinafter described.

The cementing operation for cementing casing string 20 into the well borehole (not shown) requires a passageway from lower annulus 44 around casing string 20 to upper annulus 46 around drill string 12 to flow the returns to the surface. A plurality of lower and upper flutes or circulation ports 48,50 are provided through upper section 38 of hanger 26 to permit fluid flow, such as for the cementing operation, around casing hanger 26. Lower flutes 48 provide fluid passageways through radial annular shoulder 40 and upper flutes 50 provide fluid passageways through the upper threaded end of tubular body 32 to pass fluid around sealing assembly 16. Axially extending slots 52 are provided in the walls of upper flutes 50 adapted for connection with torque multiplier subsea tool 10, hereinafter described.

Threads 54 are provided on the external periphery of upper section 38 of tubular body 32 below annular shoulder 40 to threadingly receive and engage threaded load ring 28 around hanger 26. Load ring 28 has a downwardly facing, downwardly tapering conical face 56 to matingly rest on and engage with upwardly facing, downwardly tapering conical support shoulder 24 and a threaded radial bore 58 for receiving a retaining screw 60.

Latch ring 30 is disposed in circumferential groove 62 on radial annular shoulder 40 and may be a split ring which is adapted to be expanded for engagement with wellhead housing 22 to hold and lock down hanger 26 within wellhead housing 22. Latch ring 30 includes an upwardly and inwardly facing cammimg head 64 adapted for camming engagement with sealing assembly 16, hereinafter described.

Sealing assembly 16 may be substantially as described in the above-referenced copending U.S. patent applications Ser. Nos. 348,735, 350,374, and 535,045, and includes a stationary member 66 rotatably mounted on a rotating member or packing nut 68 by retainer means 70. Packing nut 68 has a ring-like body with a lower pin 72 and a castellated upper end 74 with upwardly projecting stops 76. Castellated upper end 74 engages torque multiplier subsea tool 10, hereinafter described. The inner diameter surface of nut 68 includes threads 78 threadingly engaging the external threads 43 of casing hanger 26.

Member 66 has a ring-like body 80 and includes a sealing means 82 for sealing the annulus between casing hanger 26 and wellhead housing 22, an upper drive portion 84 for connecting member 66 to nut 68 and a lower cam portion 86 for actuating latch ring 30. Sealing means 82 is a combination primary metal-to-metal seal and secondary elastomeric seal. Upper drive portion 84 includes an upper counterbore 87 that rotatably receives lower pin 72 of packing nut 68. Retainer means 70 includes inner and outer races in counterbore 87 and pin 72 housing retainer roller cones or balls 88. Retainer means 70 merely rotatably retains member 66 on nut 68. It does not carry any load and it is not used for transmitting torque or thrust from packing nut 68 to stationary member 66. Bearing means (not shown) are provided including bearing rings (not shown) disposed between the bottom of counterbore 87 and the lower end of pin 72 to permit rotatable sliding engagement therebetween and to transmit thrust from packing nut 68 to stationary member 66. Lower cam portion 86 has a downwardly and outwardly facing cam surface 94 adapted for camming engagement with camming head 64 of latch ring 30.

Casing hanger assembly 14 and sealing assembly 16 mounted thereon are lowered into the well releasably connected to torque multiplier subsea tool 10 attached to pipe string 12. Torque multiplier subsea tool 10 includes generally an inner mandrel 102, an emergency release assembly 104, a barrel 106, a closure member 108, a connector body 110 and a planetary gear assembly 112.

Inner mandrel 102 comprises an upper sub 114 and a sun gear 116. Upper sub 114 includes a tubular body having an upper threaded box 118 for threadingly receiving a pin end 120 of drill string 12, a cylindrial bore 122 below box 118, an increased diameter bore 124 below bore 122, a middle threaded portion 126, another increased diameter bore 128 below threaded portion 126 and having axially extending grooves 130 therein, forming axially extending teeth therebetween, and a lower threaded box 132. Left hand threads 134 and a blind bore 136 above threads 134 are provided on the middle portion of the external periphery of upper sub 114 for connection with emergency release assembly 104, hereinafter described.

Sun gear 116 includes a cylindrical bore 138 having the same diameter as bore 122 of upper sub 114, an upper end portion 140 which is adapted to be intimately received within bore 124, an externally threaded portion 142 below end portion 140 which is adapted to be threadingly received within middle threaded portion 126 of sub 114, a lower increased outer diameter portion 144 having an annular, axially elongate groove 146 around its middle outer periphery, and a lower threaded pin end 148 adapted for threaded connection with box end 150 of pipe joint 18 suspended therefrom. Sun gear 116 also includes axially extending, elongate teeth 152 on its external periphery between threaded portion 142 and lower increased diameter portion 144. Teeth 152 are adapted to be received within increased diameter bore 128 of sub 114 in their upper portions, and to be matingly engaged with planetary gear assembly 112, hereinafter described, in their lower portions.

Sun gear 116 is received by upper sub 114 and threadedly connected thereto, pin 142 of sun gear 116 being threaded into portion 126 of sub 114. In that position, upper pin end 140 is intimately disposed within bore 124 and is in sealing engagement therewith, pin end 140 being provided with lip seals 154,156 disposed in circumferential grooves in its exterior periphery, and upper end 158 of sun gear 116 abuts shoulder 160, thereby connecting bores 122,138. Bores 122,138 of upper sub 114 and sun gear 116, respectively, form a flow passage therethrough connecting the flow passage of drill string 12 to the flow passage of drill string 18. Annular chambers 162,164 are formed between sun gear 116 and upper sub 114 immediately above and below the engaged threads of threaded pin 142 and threaded portion 126. Furthermore, in that position, increased diameter bore 128 and lower threaded box 132 are disposed about and spaced from the upper portion of the external periphery of sun gear 116 having teeth 152. A cylindrical spline ring 170, having axially extending grooves or splines in its interior and exterior surfaces, is inserted between sun gear 116 and sub 114 to matingly engage upper portion of teeth 152 and teeth 130 respectively, and to assist in transmitting torque from upper sub 114 to sun gear 116. Spline ring 170 is retained in place by a spline retention ring 176 disposed around teeth 152 and screwed into lower threaded box 132. Retention ring 176 includes a threaded pin end 178 and an outwardly extending pin head 180 which abuts lower end 182 of upper sub 114.

Emergency release assembly 104 includes an emergency release nut 184 and a shear sleeve 186. Emergency release nut 184 has a tubular body with a left hand threaded bore 188 and a castellated upper end 190 with upwardly projecting stops 192. Release nut 184 also includes at its lower interior periphery an increased inside diameter portion 194 extending from lower end 196 of nut 184 to an annular groove 198 below threaded bore 188 to form a housing for a portion of segmented ring 202 which connects release nut 184 to closure member 108, hereinafter described. Release nut 184 is received and made-up over upper sub 114 by threadingly engaging left hand threaded bore 188 and left hand threads 134 on the exterior of upper sub 114.

Shear sleeve 186 has a tubular body with an inner diameter dimensioned to be received over left hand threads 134 on the exterior of upper sub 114, an inwardly projecting upper flange 206 having a radial bore 208 therein, and a castellated lower end 210 with downwardly projecting stops 212 adapted to engage the radially inner portion of castellated upper end 190 of emergency release nut 184. Shear sleeve 186 is received over threads 134 with upper flange 206 in intimate contact with the exterior surface of sub 114 above threads 134 and castellated lower end 210 in engagement with the corresponding radially inner portions of castellated upper end 190 of release nut 184. Shear sleeve 186 is secured on upper sub 114, and vertical or rotational movement of shear sleeve 186 with respect to upper sub 114 is prevented, by shear pins 214 disposed in radially aligned bores 136,208 of upper sub 114 and shear sleeve 186, respectively. Shear sleeve 186 under normal or non-emergency operating conditions acts as an anti-rotation means for emergency release nut 184.

Barrel 106 includes a tubular body with a bore 218 having elongate, axially extending splines or teeth 220 on its interior upper portion corresponding to exterior axially extending splines of planetary gear assembly 112, hereinafter described; a plurality of circumferentially spaced, threaded, axially extending blind bores 222 in its upper end; a plurality of circumferentially spaced threaded radial bores 226 below axial splines 220 and at a predetermined distance above lower end 228; and a plurality of pins 230 threaded into radial bores 226 having downwardly facing conical pin ends 232 projecting into bore 218. A plurality of circumferentially spaced radial ports 234 are disposed below bores 226, providing fluid communication between the interior and the exterior of barrel 106. A plurality of longitudinally extending, circumferentially spaced grooves 236 on the exterior surface of barrel 106 extend from ports 234 to the upper end 224 of the barrel. Barrel 106 also includes a castellated lower end 238 adapted to engage corresponding castellated upper end 74 of packing nut 68. Barrel 106 is disposed around inner mandrel 102 forming annular chamber 240 therebetween. The upper end of chamber 240 is closed by closure member 108 and the lower end is closed by upwardly facing surface 246 of connector body 110 and upwardly facing shoulder 248 formed by increased outer diameter portion 144 of sun gear 116.

Closure member 108 has a ring-like body intimately received over the lower portion of upper sub 114 and sealingly engaged thereon via o-ring seal 250 disposed in an inner circumferential groove in closure member 108. The upper interior portion of member 108 includes an increased inside diameter portion 254 extending from upper end 256 to an annular groove 258 above seal 250 to form a housing for the remaining portion of segmented ring 202. Segmented ring 202, having a plurality of segments, allows rotational movement but prevents axial movement of emergency release nut 184 with respect to closure member 108. Rotational movement of release nut 184 with respect to closure member 108 is facilitated by bearing means 490 provided between lower end 196 of nut 184 and upper end 256 of closure member 108.

The downwardly facing surface of closure member 108 includes an annular groove 264 between its inner and outer peripheries and a plurality of circumferentially spaced threaded blind bores around groove 264 both radially inwardly and outwardly thereof. Annular-shaped, collapsible bellows 270 of rubber or the like are suspended from closure member 108 and retained thereon by cap screws 272,274 threaded into bellows lips 276,278 and into the blind bores around groove 264 thereby forming a variable volume bellows chamber 280 within annular chamber 240. Closure member 108 has an upwardly facing exterior conical surface 282 in fluid communication with bellows chamber 280 via a port 284 and in fluid communication with a portion of chamber 240 surrounding bellows 270 via a port 286 having exterior closing means 288. Closure member 108 further includes a downwardly facing exterior shoulder 290 abutting upper end 224 of barrel 106 and a downwardly projecting annular tongue 292 adjacent shoulder 290 in intimate contact with the upper end of the interior surface of barrel 106 above axial splines 220. O-ring seal 294 disposed in an outer circumferential groove in tongue 292 provides a sealing engagement between closure member 108 and barrel 106. A plurality of circumferentially spaced axially extending bores 296 are provided in closure member 108 in tandem with threaded blind bores 222 of barrel 106 for receiving bolts 298 to securely connect barrel 106 to closure member 108.

Connector body 110 has a generally tubular body which includes a bore 302 dimensioned to be telescopically and intimately disposed over increased diameter portion 144 of sun gear 116, and an increased diameter threaded upper bore 306 for receiving nuts 307,309. On its exterior, connector body 110 includes a threaded upper portion 308 having a plurality of circumferentially spaced, threaded radial blind bores 310 therein, an outwardly projecting flange 312 in intimate contact with the interior of bore 218 of barrel 106, a middle portion 314 having an outer diameter smaller than the inner diameter of barrel 106 thereby forming an annular chamber 316 therebetween, an outer circumferential groove 318 towards the lower end of middle portion 314 for housing a split retainer ring 320, a reduced diameter portion 322 below middle portion 314 having a plurality of circumferentially spaced threaded radial blind bores 323, and a further reduced diameter portion 324 in the lower end forming a downwardly facing annular shoulder 326 which engages the upper terminal end of casing hanger 26 upon placing torque multiplier subsea tool 10 and hanger 26 in the running position. Split retainer ring 320 has an upwardly facing exterior conical area 327 corresponding to downwardly facing conical pin ends 232 of pins 230 and a lower projection 328 for retaining split ring 320 in groove 318.

Reduced diameter portion 324 has a plurality of circumferentially spaced slots or windows 330 which slidingly house locking segments or dogs 332 having a plurality of grooves 334 forming ridges therebetween adapted to be received by circumferential grooves 42 of casing hanger 26 for releasably connecting torque multiplier subsea tool 10 to casing hanger 26. Dogs 332 have an upper projection 336 received within an annular groove around the upper inner periphery of windows 330. Above windows 330 are a plurality of seal grooves housing lip seals 344,346 for sealingly engaging the inner periphery of casing hanger 26. A castellation ring 348 is disposed around reduced diameter portion 322 and secured thereon with cap screws 350 threaded into blind bores 323 of reduced diameter portion 322. Castellations 352 of ring 348 project downwardly to matingly engage axially extending slots 52 of casing hanger 26 to prevent any rotational movement of connector body 110 relative to casing hanger 26. Castellation ring 348 includes an upper projection 354 extending over the lower section of middle portion 314 and up to groove 318 to provide a stop surface for lower projection 328 of split retainer ring 320.

Still referring to FIGS. 1A, 1B, there is shown a planetary gear assembly 112 having a generally tubular body adapted to be received in annular chamber 240 between inner mandrel 102 and barrel 106, as shown. Planetary gear assembly 112 includes a planet carrier body 356, a planet carrier ring 358, a plurality of planetary gears 360 and a stationary ring gear 362.

Planet carrier body 356 is generally tubular in configuration and includes a bore 361 for receiving the portion of sun gear 116 that has teeth 152; thickened upper section 363 having an externally projecting radial annular flange 364 which is provided on its exterior with splines or teeth 366 adapted to matingly engage interior teeth 220 of barrel 106; and circumferentially spaced bores 368 in thickened upper section 363 for housing upper axles 370 of planetary gears 360. Body 356 also includes circumferentially spaced pockets 372 (see FIG. 2) extending from its bottom end 374 to bores 368 for housing the shafts 376 of planetary gears 360; a plurality of circumferentially spaced threaded axial blind bores 378 in lower end 374; and a plurality of circumferentially spaced axial blind bores or pin holes 380 communicating with bore 361 via radial ports or vent holes 382.

Planet carrier ring 358 has an annular body which includes a central axial bore 384 with the same inside diameter as the inside diameter of bore 361, a plurality of circumferentially spaced bores 402 for housing lower axles 404 of planetary gears 360, a plurality of circumferentially spaced threaded axial bores or jack holes 386, a plurality of circumferentially spaced pin holes 388, and a plurality of circumferentially spaced bores 390 having an increased diameter counterbore portion in their lower ends. Planetary gears 360 include a cylindrical gear shaft 376 having on its exterior surface elongate, axially extending teeth 398 adapted for engaging exterior gear teeth 152 of sun gear 116 and interior gear teeth 400 of stationary ring gear 362, hereinafter described. Planetary gears 360 also include the aforementioned upper and lower axles 370,404 which have a cylindrical body with a smaller diameter than the diameter of gear shafts 376.

Ring gear 362 includes a tubular body having a bore 406, axially extending elongate teeth 400 in the interior upper portion of bore 406 adapted to matingly engage exterior teeth 398 of planetary gears 360, and a threaded lower box end 408 adapted to threadingly engage threaded exterior upper portion 308 of connector body 110. Box end 408 includes radial bores 410.

In the assembled position, ring gear 362 is received over the upper portion of connector body 110 and threaded thereon by threadingly engaging box end 408 to threaded exterior upper portion 308 of connector body 110. Bores 410 of ring gear 362 and blind radial bores 310 of connector body 110 are aligned and retaining screws 418 are threaded therein to securely retain the threaded engagement between ring gear 362 and connector body 110. Planetary gears 360 are placed in planet carrier body 356 with upper axles 370 and gear shafts 376 being received in bores 368 and their respective pockets. The lower end of planet carrier body 356 is closed by planet carrier ring 358 which receives lower axles 404 in bores 402. Planet carrier ring 358 is securely attached to planet carrier body 356 by inserting bolts 420 through bores 390 and threading them into aligned bores 378, and by inserting pins 422 in aligned pin holes 388, 380. Vent holes 382 relieve the air displaced by pins 422. Bolt heads 424, received in the counterbores at the lower ends of bores 390, have diametric bores (not shown) therethrough for inserting a wire loop (not shown) through all the bolt heads, which securely ties together all bolt heads 424. Jack holes 386 being closed in one end by lower end 374 of planet carrier body 356 may be used to separate planet carrier ring 358 from planet carrier body 356.

Bearing means 430, 432 are provided in bores 368, 402 and around axles 370, 404, respectively, to facilitate the rotation of planetary gears 360 with respect to planet carrier body 356 and planet carrier ring 358. Bearing means 430 around upper axles 370 and in bores 368 are retained therein from below by lock rings 434 located immediately below bearing means 430, and from above by an inwardly projecting shoulder in bore 368 immediately above bearing means 430. Bearing means 432 around lower axle 404 are retained therein by lock rings 436, 438 located immediately above and immediately below bearing means 432, respectively.

Thrust bearings 440, 442 are provided between the upper ends of gear shafts 376 and the upper ends of the carrier body pockets adjacent bores 368, and between the lower ends of gear shafts 376 and the upper face of planet carrier ring 358 adjacent bores 402, respectively, to absorb the axial thrust and to facilitate rotation of gears 360 with respect to planet carrier body 356 and planet carrier ring 358.

Planet carrier body 356, with the exception of thickened upper section 363, and planet carrier ring 358 containing planetary gears 360 therein are received within stationary ring gear 362. In that position, exterior teeth 398 of planetary gears 360 engage interior teeth 400 of ring gear 362. Upper end 456 of ring gear 362 is connected to lower exterior shoulder 458 of flange 364 via thrust bearing 459. A plurality of circumferentially spaced roll pins 460 disposed in blind bores in end 456 of ring gear 362 are provided to prevent rotation of thrust bearing 459. An additional thrust bearing 464 is provided between the lower end of teeth 400 in the interior of ring gear 362 and the upper end of planet carrier ring 358. Roll pins 468 like roll pins 460 prevent rotation of thrust bearing 464. Roll pins are also provided for thrust bearings 440, 442 for the same reason. It should be understood that planetary gear assembly 112 is adapted to facilitate not only the rotation of planetary gears 360 with respect to planet carrier body 356 and planet carrier ring 358, but also, to facilitate the rotation of planet carrier body 356 and planet carrier ring 358 together, with respect to ring gear 362. The latter is accomplished by engaging exterior teeth 398 of rotating planetary gears 360 with interior teeth 400 of stationary ring gear 362. This engagement causes planetary gears 360 to rotationally advance inside stationary ring gear 362 thereby rotating connected planet carrier body 356 and planet carrier ring 358 together with respect to ring gear 362. Consequently, teeth 366 on the exterior of planet carrier body 356 engaging teeth 220 of barrel 106 rotate, thereby causing barrel 106 to rotate in the same direction as planet carrier body 356 and planet carrier ring 358.

Figure 2:
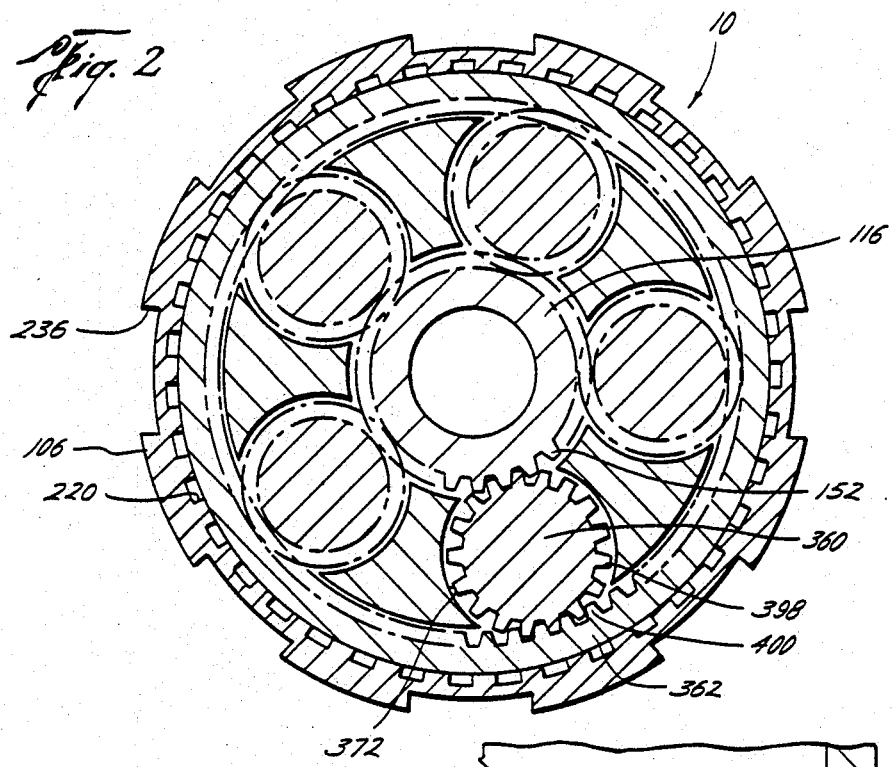
FIG. 2 is a transverse sectional view of the apparatus shown in FIG. 1A, taken along the plane shown by line 2—2 in FIG. 1A.

Referring now to FIG. 2 there is shown a horizontal crosssectional view of the engaged gear parts along line 2—2 of FIG. 1A. There is shown sun gear 116 with its exterior teeth 152 engaging exterior teeth 398 of planetary gears 360. Diametrically opposite to sun gear 116-planetary gear 360 engagement, exterior teeth 398 of planetary gear 360 engage interior teeth 400 of ring gear 362. Exterior teeth 366 (not shown) of planet carrier body 356 engage interior teeth 220 of barrel 106. A clockwise rotation of sun gear 116 causes planetary gears 360 to rotate counter-clockwise and to advance clockwise in the interior of stationary ring gear 362. Consequently, planet carrier body 356 rotates clockwise causing barrel 106 to rotate clockwise also.

Referring again to FIGS. 1A,1B, there is shown assembled torque multiplier subsea tool 10 in the running position having casing hanger assembly 14 and sealing assembly 16 attached thereto. Upper sub 114 and sun gear 116 are connected by threadingly engaging pin portion 142 of sun gear 116 to threaded portion 126 of sub 114. This engagement is sealed by lip seals 154,156. Spline ring 170 inserted between sub 114 and sun gear 116 and retained therebetween by spline retention ring 176, engages teeth 130 of sub 114 and the upper portion of teeth 152 of sun gear 116 thereby assisting in transmitting torque from upper sub 114 to sun gear 116 and preventing rotational movement of upper sub 114 and sun gear 116 with respect to each other.

Connector body 110 is slidingly disposed about increased diameter portion 144 of sun gear 116 having nuts 307,309 screwed into upper bore 306 and forming a downwardly facing interior shoulder 468 therewith, which abuts upwardly facing shoulder 248 of sun gear 116. Lip seals 470,472 disposed in outer circumferential grooves in the exterior of increased diameter portion 144 above groove 146 seal between sun gear 116 and connector body 110. In the running position, casing hanger 26 is received over reduced diameter portion 324 of connector body 110 with its upper terminal end abutting downwardly facing annular shoulder 326 and is sealed therebetween by lip seals 344,346. Lower ridge 478 of increased diameter portion 144 is adjacent to and in engagement with the internal side of dogs 332 and causes their ridges formed by grooves 334 to securely engage circumferential grooves 42 of casing hanger 26 thereby securely engaging casing hanger 26 with torque multiplier subsea tool 10. Connector body 110 further engages casing hanger 26 through castellation ring 348 which is securely connected to reduced diameter portion 322 of connector body 110 and has castellations 352 projecting downwardly and matingly engaging axially extending slots 52 of casing hanger 26. The latter engagement prevents connector body 110 from rotating with respect to casing hanger 26.

Planetary gear assembly 112, assembled as previously described, is coaxially disposed around sun gear 116 with planetary gear teeth 398 being in mating engagement with sun gear teeth 152 and stationary ring gear teeth 400. Box end 408 of ring gear 362 is threadingly connected to exterior upper portion 308 of connector body 110 and retained thereon by retaining screws 418.

Barrel 106 is disposed over planetary gear assembly 112 and connector body 110. Interior barrel teeth 220 engage exterior planet carrier body teeth 366 and barrel 106 is in intimate contact with flange 312 of connector body 110 and sealed therebetween by o-ring seal 480 disposed in an outer circumferential groove in flange 312. The upper portion of barrel 106 is connected to closure member 108 by bolts 298 and is sealed with respect thereto by o-ring seal 294. Castellated lower end 238 of barrel 106 engages corresponding castellations in upper end 74 of packing nut 68 to transmit rotational movement and torque from barrel 106 to packing nut 68. Pins 230 are located below flange 312 and above retainer ring 320. Ports 234, below pins 230, provide fluid communication between annular chamber 316 and axial grooves 236 which are on the exterior surface of barrel 106.

Packing nut 68 of sealing assembly 16 is partially threaded to threads 43 at the top of casing hanger 26. Stationary member 66 of sealing assembly 16 is rotatably retained on packing nut 68 through upper drive portion 84 which rotatably receives lower pin 72 of nut 68. The remaining portion of member 66 is coaxially and slidingly disposed about casing hanger 26. Stationary member 66 is free to rotate with respect to packing nut 68. Roller balls 88 and a thrust bearing means (not shown) disposed between the bottom of counterbore 87 and the lower end of pin 72 facilitate such rotational motion. Furthermore, such thrust bearing means transmits thrust from packing nut 68 to stationary member 66.

Closure member 108 is intimately received over upper sub 114 and sealed therebetween via o-ring seal 250. Bellows 270 are attached to the downwardly facing surface of member 108 to form a variable volume bellows chamber 280 which is in continuous fluid communication with the exterior of torque multiplier subsea tool 10 via ports 284. Chamber 240 surrounding bellows 270 and planetary gear assembly 112 is filled with lubricant oil via port 286 which is closed by cap means 288. Variable volume bellows chamber 280 being in constant fluid communication with the exterior of torque multiplier subsea tool 10 via port 284 is exposed to the same fluid pressure as the exterior of subsea tool 10. Furthermore, bellows chamber 280 transmits the same pressure to chamber 240 and its enclosed fluid, whereby there is no pressure differential between the exterior of subsea tool 10 and chamber 240 and any leakage to or from chamber 240 from or to the exterior of tool 10 is prevented.

Emergency release nut 184 is screwed in the entire length of left hand threads 134 of upper sub 114. Closure member 108 is placed immediately thereunder and is separated therefrom by a thrust bearing means 490 which facilitates the rotational movement of closure member 108 and barrel 106 with respect to emergency release nut 184. Segmented retaining ring 202 projecting into grooves 198,258 of emergency release nut 184 and closure member 108, respectively, allows rotational movement but prevents axial movement of closure member 108 with respect to emergency release nut 184. Therefore, any axial movement of closure member 108 must be concurrent with an axial movement of emergency release nut 184 in the same direction and vice versa.

Shear sleeve 186 is partially received over threads 134 with its castellated lower end 210 engaging the inner portion of castellated upper end 190 of emergency release nut 184. Shear pins 214 connect shear sleeve 186 and upper sub 114 and prevent any rotational or axial movement of shear sleeve 186 thereon.

Still referring to FIGS. 1A,1B, in the running position, torque multiplier subsea tool 10 is suspended from drill string 12 and has attached thereto, as previously described, casing hanger assembly 14 and sealing assembly 16. Also, drill string 18 and casing string 20 are suspended from torque multiplier subsea tool 10 and casing hanger 26, respectively. The assembled tool string is lowered into wellhead housing 22 to rest conical face 56 of load ring 28 on conical support shoulder 24.

A cementing operation may be performed at this time, for cementing casing string 20 into the well borehole (not shown). Cement is pumped down a flow passage through drill string 12, torque multiplier subsea tool 10 and drill string 18. The returns flow to the surface from lower annulus 44 via lower flutes 48, upper flutes 50, annular chamber 316, ports 234, axial grooves 236 and upper annulus 46 around drill string 12.

After the cementing operation is completed, torque is applied to packing nut 68 on sealing assembly 16 to set the seal in the annulus around casing hanger 26. To accomplish this, drill string 12 is rotated to the right causing upper sub 114, emergency release nut 184, shear sleeve 186 and sun gear 116 to rotate likewise. Rotating sun gear 116 sets in motion planetary gear assembly 112, as previously described, and causes barrel 106 and packing nut 68 to rotate to the right, and to advance downwards on threads 43. In turn, stationary member 66 biased by packing nut 68 advances downwards until lower cam portion 86 of stationary member 66 reaches and engages camming head 64 of latch ring 30 to activate latch ring 30. When the downward movement of stationary member 66 stops because latch ring 30 prevents it, member 66 begins to expand under the compression thrust exerted on it by downwardly advancing packing nut 68 until the desired sealing pressure is reached. In order to reach the desired sealing pressure, torque is applied on rotating drill string 12 and sun gear 116. The aforementioned combination of sun gear 116, planetary gear assembly 112 and barrel 106 causes the torque output exerted by barrel 106 on packing nut 68 to be considerably higher than the torque input exerted on sun gear 116 through drill pipe 12. As will be understood by those skilled in this art, the ratio of torque output to torque input depends on various parameters including dimensions and numbers of gears. In the present invention which utilizes one sun gear, five planetary gears and one ring gear in the configuration substantially as shown in the drawings, the torque output to torque input ratio has been observed to be about 4 to 1. The downward advancement of packing nut 68 on threads 43 in response to the torque output exerted on it by barrel 106 transmits this torque output to a downward thrust that compresses stationery member 66 and the sealing means carried thereon to the desired sealing pressure. Therefore, utilizing the present invention, a seal assembly may be torque set at a higher rated capacity with torque applied on the drill string that is four times lower in magnitude than the torque exerted on the seal assembly.

The downward movement of sealing assembly 16 causes barrel 106, closure member 108, emergency release nut 184, shear sleeve 186, upper sub 114 and sun gear 116 to move downwards while connector body 110 and planetary gear assembly 112 remain stationary. During the axial movement of sun gear 116 and barrel 106 with respect to planetary gear assembly 112, sun gear teeth 152 and barrel teeth 220 remain engaged with planetary gear teeth 398 and planet carrier body teeth 366, respectively. When ridge 478 moves to a lower position below windows 330, dogs 332 collapse back into groove 146 and ridges formed by grooves 334 disengage from grooves 42 of casing hanger 26 thereby releasing casing hanger 26 from torque multiplier subsea tool 10.

Figure 4:
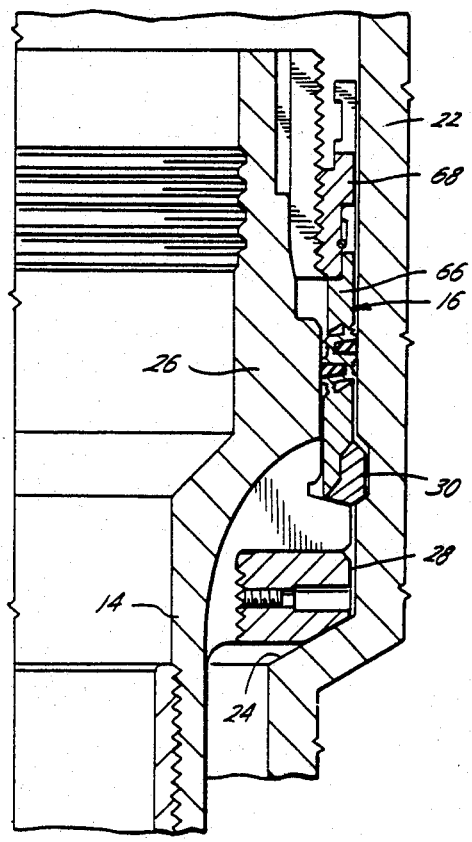
FIG. 4 is a longitudinal sectional view of the right hand portion of the casing hanger assembly and the sealing assembly following the removal of the apparatus of the present invention from the well.
Figure 3A:
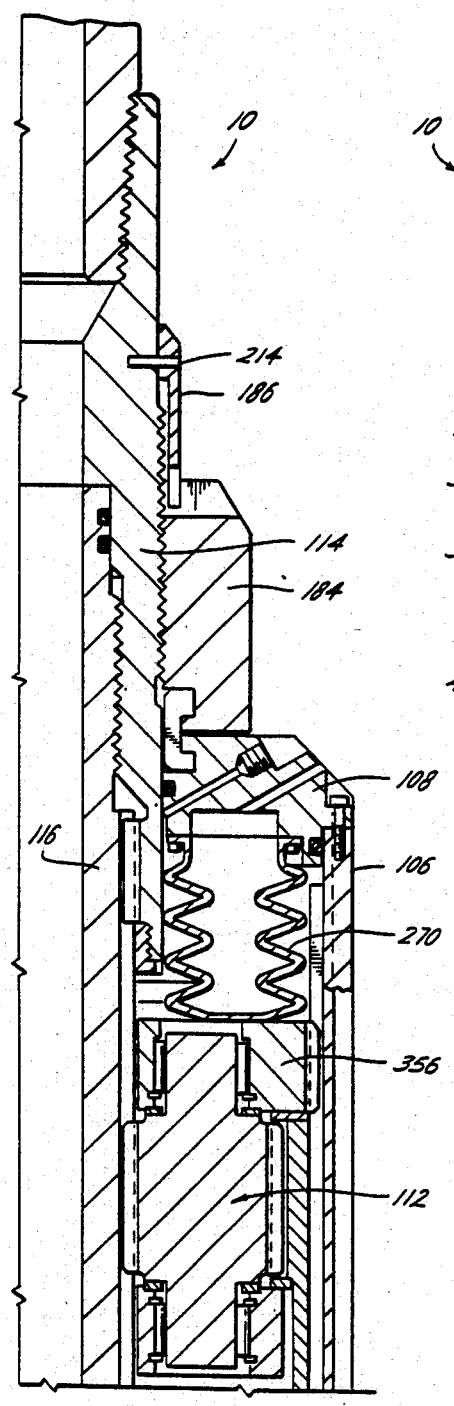
FIG. 3A is a longitudinal sectional view of the upper, right hand portion of the preferred embodiment of the apparatus of the present invention, showing the position of the components of the apparatus following the setting of the sealing assembly and the disengagement of the apparatus from the casing hanger under normal conditions.
Figure 3B:
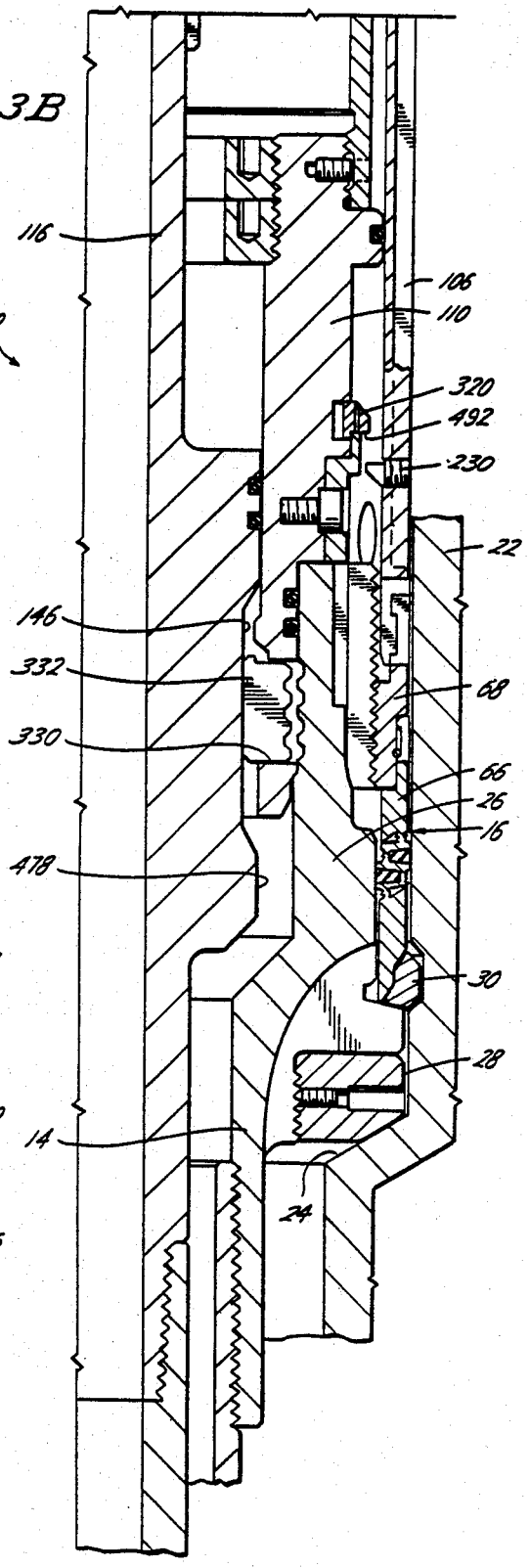
FIG. 3B is a longitudinal sectional view of the lower, right hand portion of the preferred embodiment of the apparatus of the present invention shown in FIG. 3A, showing the position of the components of the apparatus following the setting of the sealing assembly and the disengagement of the apparatus from the casing hanger under normal conditions.

Referring now to FIGS. 3A,3B, there is shown torque multiplier subsea tool 10 following the setting of sealing assembly 16 and the release of casing hanger 26. Stationary member 66 has been compressed to the desired sealing pressure immediately above latch ring 30 thereby sealing the annulus around casing hanger 26. Packing nut 68, barrel 106, closure member 108, emergency release nut 184, shear sleeve 186, upper sub 114 and sun gear 116 have moved downwards with respect to connector body 110 and planetary gear assembly 112. In that position, dogs 332 have collapsed back into groove 146, bellows 270 have partially collapsed under the resistance of planet carrier body 356, pins 230 have moved below split retainer ring 320 and the torque multiplier subsea tool 10 is ready to be lifted straight up to the surface leaving casing hanger assembly 14 and sealing assembly 16 in wellhead housing 22 at the bottom of the sea as shown in FIG. 4. In the lifting position, pins 230 abut lower end 492 of split retainer ring 320 to remove connector body 110 from casing hanger 26. This prevents ridge 478 from moving upwards with respect to windows 330 of connector member 110 and from reengaging dogs 332 with grooves 42 when torque multiplier subsea tool 10 is lifted up.

Figure 5A:
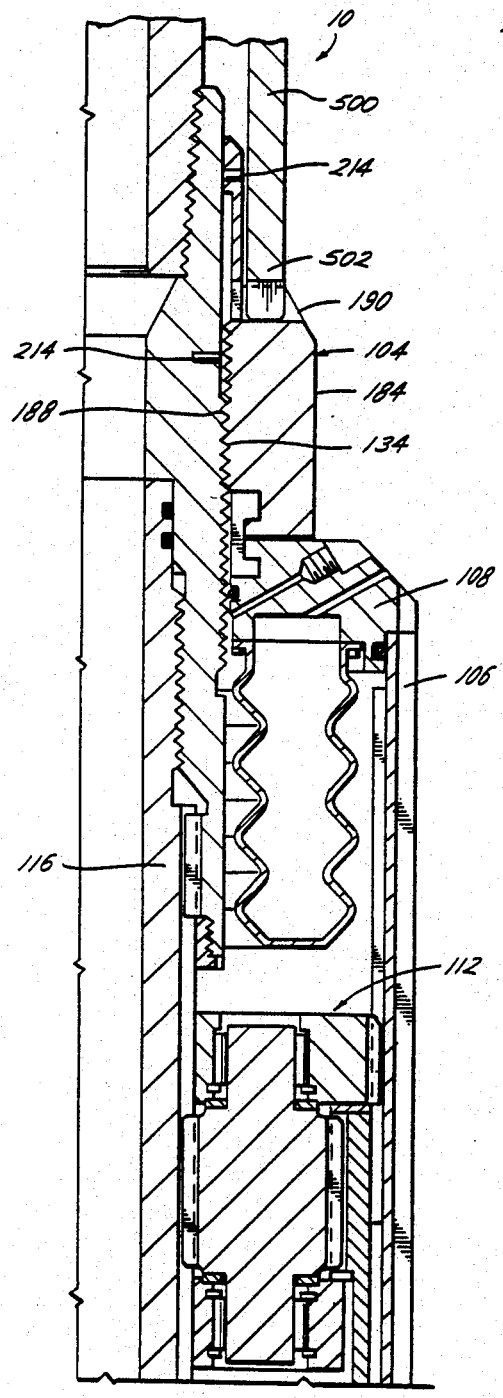
FIG. 5A is a longitudinal sectional view of the upper, right hand portion of the preferred embodiment of the apparatus of the present invention, showing the position of the components following actuation of the emergency release assembly.
Figure 5B:
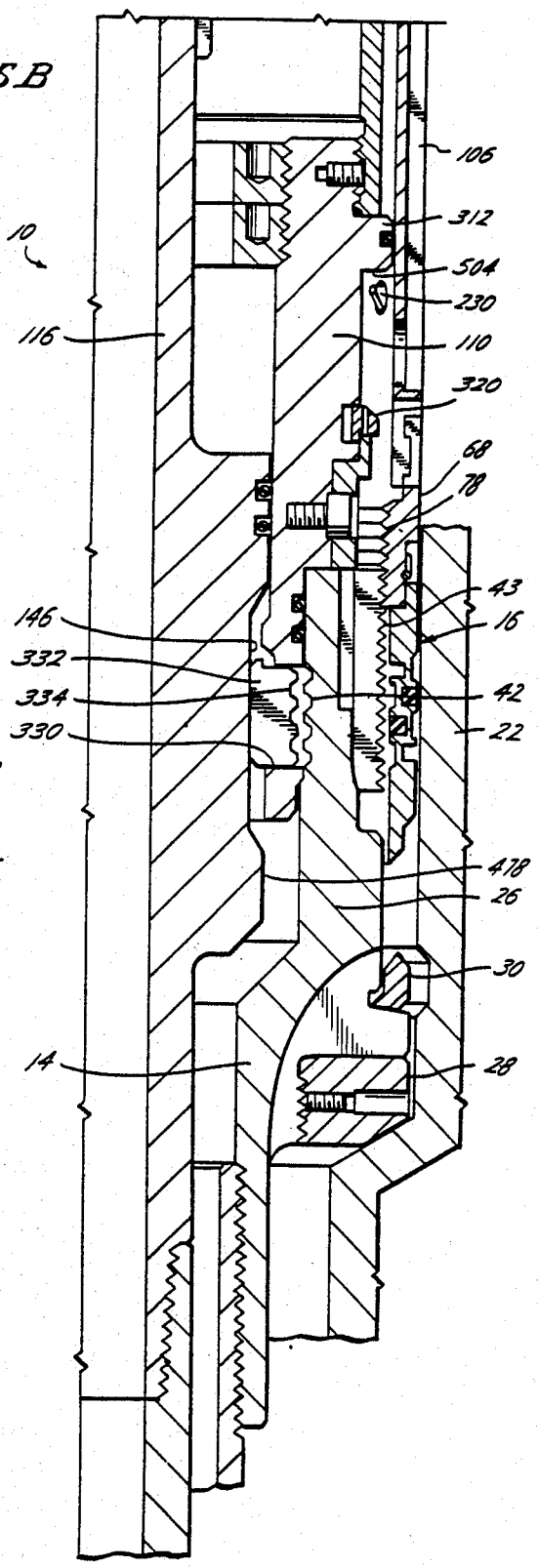
FIG. 5B is a longitudinal sectional view of the lower, right hand portion of the preferred embodiment of the apparatus of the present invention shown in FIG. 5A, showing the position of the components following actuation of the emergency release assembly.

Referring now to FIGS. 5A,5B, there is shown torque multiplier subsea tool 10 in an emergency release position. It is possible that during the seal setting operation, the advancement of packing nut 68 downwards on threads 43 of casing hanger 26 may be prevented because, for example, of failure of threads 43 or threads 78 of packing nut 68 and the threaded connection therebetween. In that event, sun gear 116 can not move downwards as previously described in normal operation to disengage dogs 332 from grooves 42 because barrel 106 can not move downwards. Therefore, unless emergency release means are provided, torque multiplier subsea tool 10 would remain securely connected to casing hanger 26 and it would be necessary to raise the whole tool string to the surface for repairs.

In order to prevent this potential difficulty, previously described emergency release assembly 104 is provided for the present invention. In the event that emergency release is required, an overshot tool 500 having a lower castellated end 502 is lowered to torque multiplier subsea tool 10. Lower castellated end 502 engages the outer portion of castellated upper end 190 of emergency release nut 184. Overshot tool 500 is rotated to the right to shear pin 214. The right hand rotation is continued thereby unscrewing emergency release nut 184 from left hand threads 134 and moving sun gear 116 downwards with respect to emergency release nut 184, closure member 108, barrel 106, connector body 110 and planetary gear assembly 112. Therefore, ridge 478 moves to a position below windows 330 and dogs 332 collapse back into groove 146 from grooves 42, thereby releasing casing hanger 26 as in the normal operation. Following emergency release, torque multiplier subsea tool 10 may be lifted straight up out of the well leaving casing hanger assembly 14 and sealing assembly 16 at the bottom of the sea for repairs to be carried out with appropriate tools lowered thereto. Reengagement of dogs 332 with casing hanger 26 is prevented during lifting by abutting lower end 504 of flange 312 with pins 230 to remove connector body 110 from casing hanger 26.

While a preferred embodiment of the present invention has been shown and described, modifications thereof can be made by one skilled in the art without departing from the spirit of the invention. For example, it should be understood that the present invention is not limited to running a casing hanger assembly 14 and a sealing assembly 16 into a subsea wellhead housing 22, but that it may be used for running, setting, and sealing various subsea well tools requiring the same. For example, torque multiplier subsea tool 10 may be used for running, setting and sealing a tubing hanger within a tubing head of a subsea well. Also, it should be understood that the invention is not limited to setting a sealing assembly substantially as described and that other sealing assemblies which are set by compression may be used. Furthermore, it should be understood that the invention is not limited to a torque output to torque input ratio of 4 to 1 and that it may be modified by one skilled in the art to operate with other torque output to torque input ratios.

What is claimed is:

1. A tool for running a casing hanger and a sealing assembly including a sealing member on a drill string into a subsea wellhead, and for setting the sealing member in the annulus between the casing hanger and a surrounding tubular member, comprising:

means for releasably attaching the casing hanger and the sealing assembly to the tool;

mandrel means adapted for connecting the tool to the drill string and for receiving an input torque from the drill string;

multiplying means cooperable with said receiving means for multiplying the input torque into an increased output torque;

means cooperable with said multiplying means for transmitting the increased output torque to the sealing assembly for advancing the sealing assembly axially in the annulus to set the sealing member; and first means disposed on said mandrel means for automatically releasing said releasably attaching means for disengaging the tool from the casing hanger upon a predetermined axial movement of a portion of the sealing assembly in setting the sealing member, whereby the tool may be lifted up and removed to the surface.

2. A tool according to claim 1 further including means for preventing the reengagement of said releasably attaching means with the casing hanger while the tool is being lifted up to the surface.

3. A tool according to claim 1 further including second means for releasing said releasably attaching means for disengaging the tool from the casing hanger in the event said first means fail, whereby the tool may be lifted up and removed to the surface.

4. A tool according to claim 3 further including means for preventing the reengagement of said releasably attaching means with the casing hanger while the tool is being lifted up to the surface.

5. A tool for running a casing hanger and a sealing assembly including a sealing member on a drill string into a subsea wellhead, and for setting the sealing member in the annulus between the casing hanger and a surrounding tubular member, comprising;

means for releasably attaching the casing hanger and the sealing assembly to the tool;

means for receiving an input torque;

means cooperable with said receiving means for multiplying the input torque into an increased output torque;

means cooperable with said multiplying means for transmitting the increased output torque to the sealing assembly to set the sealing member;

first means for releasing said releasably attaching means for disengaging the tool from the casing hanger; and second means for releasing said releasably attaching means for disengaging the tool from the casing hanger in the event said first means fail, whereby the tool may be lifted up and removed to the surface.

6. A tool according to claim 5 further including means for preventing the reengagement of said releasably attaching means with the casing hanger while the tool is being lifted up to the surface.

7. A tool for running a casing hanger and a sealing assembly including a sealing member on a drill string into a subsea wellhead, and for setting the sealing member in the annulus between the casing hanger and a surrounding tubular member, comprising;

means for releasably attaching the casing hanger and the sealing assembly to the tool;

means for receiving an input torque;

means cooperable with said receiving means for multiplying the input torque into an increased output torque;

means cooperable with said multiplying means for transmitting the increased output torque to the sealing assembly to set the sealing member;

first means for releasing said releasably attaching means for disengaging the tool from the casing hanger, whereby the tool may be lifted up and removed to the surface, and wherein said input torque receiving means includes an inner mandrel having an axially elongated sun gear thereon;

said increased output torque transmitting means includes an outer barrel disposed around said inner mandrel and forming an annular chamber therebetween, said outer barrel having axially elongated teeth around its inner periphery and torque coupling portions on one end for engaging correlatively shaped torque coupling portions of the sealing assembly;

said releasably attaching means includes a connector body disposed around said mandrel and having radially movable latches movable between a latched position engaging the casing hanger and preventing relative axial movement of the casing hanger and said connector body and an unlatched position disengaged from the casing hanger and permitting such relative axial movement, and an antirotation coupling between said connector body and the casing hanger;

said multiplying means includes a planetary gear assembly disposed around said mandrel in said annular chamber, said assembly including a stationary ring gear mounted on said connector body and radially spaced from said sun gear, a plurality of planet gears disposed in the space between and engaging said sun gear and said ring gear, and a carrier body housing said planet gears therewith, said carrier body having exterior teeth engaging said teeth on the inner periphery of said barrel; and said first releasing means including rotatable connecting means connecting said outer barrel to said inner mandrel for permitting relative rotation but preventing relative axial movement therebetween, biasing means on said mandrel for biasing said latches in said latched position when said barrel and said mandrel are in the running position, and release means on said mandrel for permitting said latches to move to the unlatched position upon a predetermined axial movement of said outer barrel and said mandrel from said running position in setting the sealing member.

8. A tool adapted for suspension from a drill string for running a casing hanger and a sealing assembly including a sealing member into a subsea wellhead, and for setting the sealing member in the annulus between the casing hanger and the wellhead by applying torque on the sealing assembly through right-hand rotation, comprising:

an inner mandrel including a sun gear;

a barrel having interior barrel teeth being disposed around said inner mandrel and forming an annular chamber therebetween with said inner mandrel, said barrel further including antirotational castellations for engaging the sealing assembly;

a planetary gear assembly disposed in the annular chamber and engaging the sun gear and the barrel teeth; and a connector body disposed around said inner mandrel including radially movable latches for releasably engaging the casing hanger.

9. A tool according to claim 8 wherein said connector body includes castellations for antirotationally engaging the casing hanger.

10. A tool according to claim 9 wherein said connector body is connected to said planetary gear assembly.

11. A tool according to claim 8 wherein said inner mandrel further includes a first portion biasing the latches to a first position engaging the casing hanger with the tool and a second portion releasing the latches to a second position disengaging the casing hanger from the tool allowing the tool to be lifted from the casing hanger and removed to the surface.

12. A tool according to claim 11 further including an inward projection on said barrel engageable with an outward projection on said connector body when the tool is being lifted to the surface for preventing said first portion of said mandrel from biasing the latches to the first position, whereby the reengagement of the tool to the casing hanger when the tool is lifted up is prevented.

13. A tool according to claim 11 further including:

a closure member being rotationally disposed around said inner mandrel and connected to said barrel;

an emergency release nut being made-up over said inner mandrel in a left-hand threaded engagement;

means for maintaining the threaded engagement between said emergency release nut and said inner mandrel during the right-hand rotation; and a ring connecting said closure member to said emergency release nut and allowing rotational movement but preventing axial movement of said closure member with respect to said emergency release nut.

14. A tool according to claim 13 wherein said means maintaining the threaded engagement include a sleeve releasably connected to said inner mandrel by a shear pin and antirotationally engaging said emergency release nut.

15. A tool according to claim 8 wherein said barrel includes external axial grooves and radial ports communicating with said external axial grooves.

16. A tool according to claim 8 wherein said planetary gear assembly comprises:

a rotationally fixed ring gear;

a plurality of rotatable planetary gears engaging said sun gear and said ring gear; and a rotatable planet carrier body housing said planetary gears and having teeth engaging the barrel teeth of said barrel.

17. A tool according to claim 16 wherein said planetary gear assembly includes five planetary gears.

18. A tool for running a casing hanger and a sealing assembly including a sealing member on a drill string into a subsea wellhead, and for setting the sealing member in the annulus between the casing hanger and a surrounding tubular member, comprising:

means for receiving an input torque, said input torque receiving means including an inner mandrel being connected to the drill string;

means cooperable with said receiving means for multiplying the input torque into an increased output torque;

means cooperable with said multiplying means for transmitting the increased output torque to the sealing assembly for advancing the sealing assembly axially in the annulus to set the sealing member;

a connector body disposed around said mandrel and having radially movable latches movable between a latched position engaging the casing hanger and preventing relative axial movement of the casing hanger and said connector body and an unlatched position disengaged from the casing hanger and permitting such relative axial movement, and an antirotation coupling between said connector body and the casing hanger; and first means for releasing said latches to the unlatched position for disengaging the tool from the casing hanger, whereby the tool may be lifted up and removed to the surface.

19. A tool according to claim 18 further including means for preventing the reengagement of said latches with the casing hanger while the tool is being lifted up to the surface.

20. A tool according to claim 18 further including second means for releasing said latches for disengaging the tool from the casing hanger in the event said first means fail, whereby the tool may be lifted up and removed to the surface.

21. A tool according to claim 20 further including means for preventing the reengagement of said latches with the casing hanger while the tool is being lifted up to the surface.

22. A tool according to claim 18 wherein said first releasing means includes biasing means on said mandrel for biasing said latches in said latched position when said mandrel is in the running position, and release means on said mandrel for permitting said latches to move to the unlatched position upon a predetermined axial movement of said mandrel from said running position in setting the sealing member.

23. A tool according to claim 18 wherein said increased output torque transmitting means includes an outer barrel disposed around said inner mandrel and forming an annular chamber therebetween, said outer barrel having torque coupling portions on one end for engaging correlatively shaped torque coupling portions of the sealing assembly.

24. A tool according to claim 23 wherein said first releasing means includes rotatable connecting means connecting said outer barrel to said inner mandrel for permitting relative rotation but preventing relative axial movement therebetween, biasing means on said mandrel for biasing said latches in said latched position when said barrel and said mandrel are in the running position, and release means on said mandrel for permitting said latches to move to the unlatched position upon a predetermined axial movement of said outer barrel and said mandrel from said running position in setting the sealing member.

25. A tool according to claim 23 wherein said mandrel includes a sun gear, said barrel includes axially elongated teeth around its inner periphery, and said multiplying means includes a planetary gear assembly disposed around said mandrel in said annular chamber, said assembly including a stationary ring gear mounted on said connector body and radially spaced from said sun gear, a plurality of planet gears disposed in the space between and engaging said sun gear and said ring gear, and a carrier body housing said planet gears therewithin, said carrier body having exterior teeth engaging said teeth on the inner periphery of said barrel.

26. A tool according to claim 23 further including:

a closure member being rotationally disposed around said inner mandrel and connected to said barrel;

an emergency release nut being made-up over said inner mandrel in a left-hand threaded engagement;

means for maintaining the threaded engagement between said emergency release nut and said inner mandrel during righthand rotation of said mandrel; and a ring connecting said closure member to said emergency release nut and allowing rotational movement but preventing axial movement of said closure member with respect to said emergency release nut.

27. A tool according to claim 26 wherein said means maintaining the threaded engagement include a sleeve releasably connected to said inner mandrel by a shear pin and antirotationally engaging said emergency release nut.

* * * * *